US010881216B1

(12) United States Patent
Shultz

(10) Patent No.: US 10,881,216 B1
(45) Date of Patent: Jan. 5, 2021

(54) SHEET RETAINER

(71) Applicant: Monika Shultz, Jennings, LA (US)

(72) Inventor: Monika Shultz, Jennings, LA (US)

( * ) Notice: Subject to any disclaimer, the term of this patent is extended or adjusted under 35 U.S.C. 154(b) by 0 days.

(21) Appl. No.: 16/163,730

(22) Filed: Oct. 18, 2018

(51) Int. Cl.
*A47C 21/02* (2006.01)

(52) U.S. Cl.
CPC ..... *A47C 21/022* (2013.01)

(58) Field of Classification Search
CPC ... A47C 21/022; A47C 21/026; A47C 23/007; Y10T 24/23
See application file for complete search history.

(56) References Cited

U.S. PATENT DOCUMENTS

| | | | | | |
|---|---|---|---|---|---|
| 2,154,557 | A * | 4/1939 | Bechik | A47C 21/026 | 5/411 |
| 3,092,848 | A | 6/1963 | Gronvold | | |
| 4,017,919 | A * | 4/1977 | Hemmeter | A47C 21/026 | 5/411 |
| 4,199,831 | A * | 4/1980 | Muller | A47C 21/022 | 5/411 |
| 4,773,108 | A * | 9/1988 | Leever | A47C 21/022 | 24/72.5 |
| 4,782,543 | A * | 11/1988 | Hutton | A47C 21/022 | 24/72.5 |
| 6,708,357 | B2 * | 3/2004 | Gaboury | A47C 23/007 | 5/663 |
| D573,013 | S * | 7/2008 | Lavelle | D8/403 | |
| 8,522,376 | B2 * | 9/2013 | Rohr | A47C 21/026 | 5/411 |
| D703,909 | S * | 4/2014 | Freeman | D34/38 | |
| 8,745,787 | B1 | 6/2014 | Heimlich | | |
| 9,254,046 | B1 * | 2/2016 | Arenstein | A47C 21/022 | |
| 2013/0283528 | A1 * | 10/2013 | Tzur | A47C 21/022 | 5/498 |

* cited by examiner

*Primary Examiner* — Robert Sandy
*Assistant Examiner* — Louis A Mercado
(74) *Attorney, Agent, or Firm* — Sanchelima & Associates, P.A.; Jesus Sanchelima; Christian Sanchelima

(57) ABSTRACT

A sheet retainer to retain a sheet fitted onto a bed in a wrinkle free or taut condition is disclosed herein. The sheet retainer includes a base member, a rail member, and a grip member. The rail member extends vertically from at least a portion of an end of the base member. The base member is placed beneath a corner edge of the mattress securing the bed sheet and pushed or butted against the rail member to maintain the bed sheet onto the mattress in a taut position. The base member includes a textured surface to retain the bed sheet fitted onto the mattress in the taut condition and prevent dislodging of bed sheet from the mattress. Advantageously, the sheet retainer holds the bed sheet tucked beneath the mattress in taut condition without causing damage to the bed sheet, or to the user during use.

8 Claims, 3 Drawing Sheets

SHEET RETAINER

BACKGROUND OF THE INVENTION

1. Field of the Invention

The present disclosure relates to a sheet retainer. More particularly, the present disclosure relates to a sheet retainer to retain a bed sheet fitted onto a mattress in wrinkle-free or taut condition.

2. Description of the Related Art

One of the major problems with bedding is maintaining a bed sheet secured over a mattress in wrinkle-free or taut condition. Heretofore, attempts have been made to provide various arrangements for attaching the bed sheet securely to the mattress. One such arrangement includes usage of elastic band at a hem of the bed sheet that helps to hold the bed sheet tautly. Another arrangement involves usage of clips to hold the edge of bed sheet underneath the mattress. However, these arrangements are either too complex in construction or lack to provide satisfactory function.

Several devices have been designed in the past. None of them, however, include a sheet retainer that is capable of addressing the foregoing discussed issues.

Applicant believes that a related reference corresponds to U.S. Pat. No. 3,092,848A filed by George B. Gronvold describes a bed sheet holder. The George reference discloses a bed sheet holder comprising a fastener means. The fastener means includes an elastic band to embrace each corner of the mattress under tension and a gripping means mounted on each band for receiving a corner of the sheet with a gripping and tensioning force. However, the George reference is prone to tearing, ripping or severing the threads of the bed sheet material.

Another related reference is U.S. Pat. No. 8,745,787B1 filed by Nathan Richard Heimlich describes a bed sheet anchoring system. The Nathan reference discloses a sheet anchoring system to restrain the periphery of a fitted sheet on a bed. The sheet anchoring system includes a plurality of pivotable clips each having a first end and a second end. The first end comprises an engaging friction surface to grasp a portion of the periphery of the sheet without the need for a spring or other force-biasing mechanism. The second end also has engaging surfaces forced into engagement by the weight of the mattress on top of the second end, when the second end is placed between the mattress and a box spring below the mattress. However, the Nathan reference also uses clips for retaining the sheet fitted on the bed, which may damage the bed sheet material during use. Further, the Nathan reference comprises a complex construction, which would be expensive to manufacture.

Other documents describing the closest subject matter provide for a number of more or less complicated features that fail to solve the problem in an efficient and economical way. None of these patents suggest the novel features of the present invention.

SUMMARY OF THE INVENTION

It is an object of the present invention to provide a sheet retainer to retain a bed sheet fitted onto a mattress in wrinkle-free or taut condition.

It is another object of the present invention to provide a sheet retainer comprising a base member having a textured surface, and a rail member extending vertically from at least a portion of an end of the base member, wherein the base member is placed beneath a corner edge of a mattress securing a bed sheet underneath and butted against the rail member to maintain the bed sheet onto the mattress in a taut position.

It is yet another object of the present invention to provide a sheet retainer comprising a base member having a textured surface, and a rail member extending vertically from at least one corner area of the base member, wherein the base member is placed beneath a corner edge of a mattress securing a bed sheet underneath and butted against the rail member to maintain the bed sheet onto the mattress in a taut position.

It is yet another object of the present invention to provide a sheet retainer made of silicone material.

It is another object of the present invention to provide a sheet retainer, which is simple in structure, easy to install and remove while making bed.

Further objects of the invention will be brought out in the following part of the specification, wherein detailed description is for the purpose of fully disclosing the invention without placing any limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
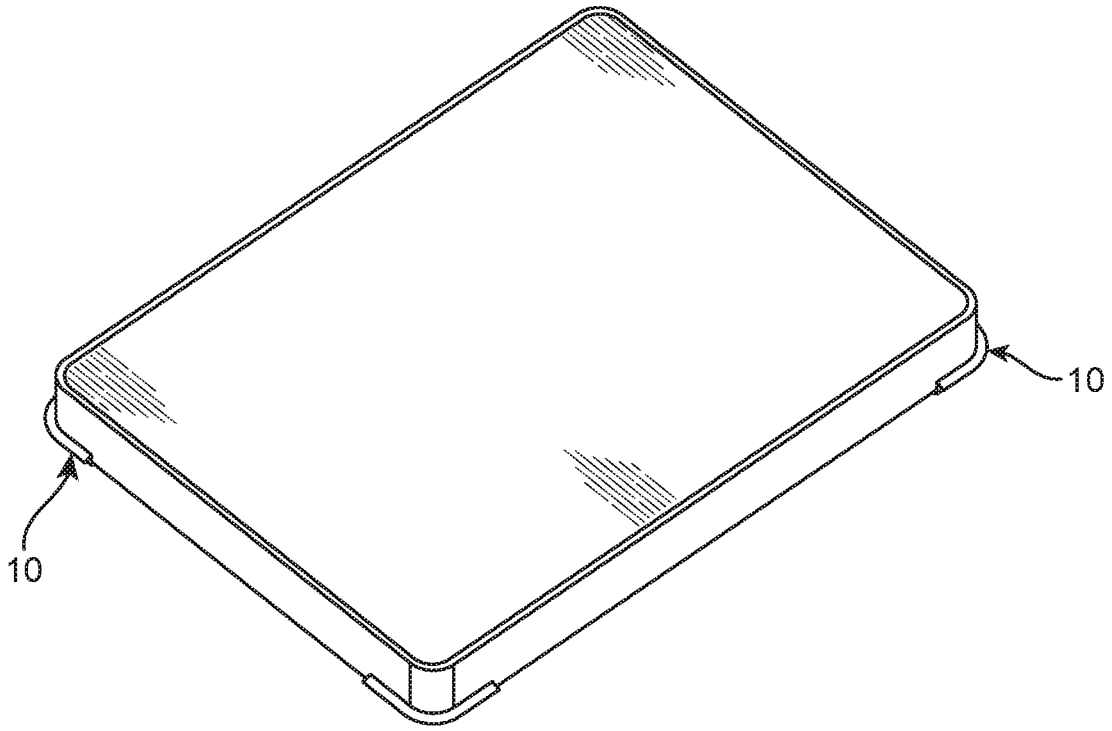
FIG. 1 exemplarily illustrates a perspective view of a bed equipped with a sheet retainer 10 in an embodiment of the present invention.
Figure 2:
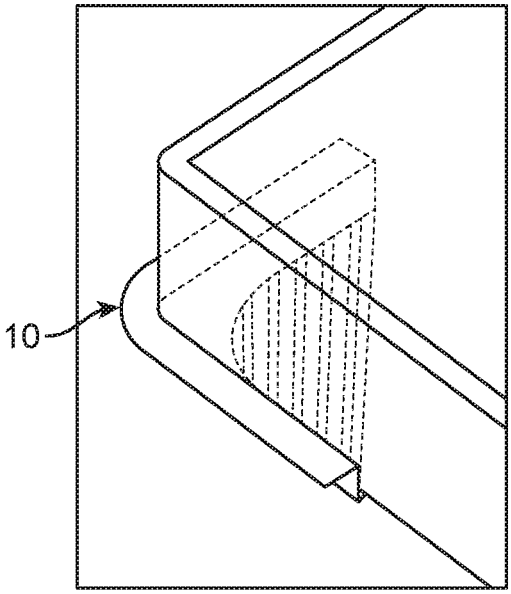
FIG. 2 exemplarily illustrates a detailed view of the sheet retainer 10 holding a bed sheet tucked underneath the mattress in an embodiment of the present invention.

Referring now to the drawings, FIGS. 1-4, where the present invention is generally referred with numeral 10, it can be observed that a sheet retainer (10, 20) to retain a bed sheet fitted onto a bed or mattress in wrinkle-free or taut condition, is disclosed.

Figure 3:
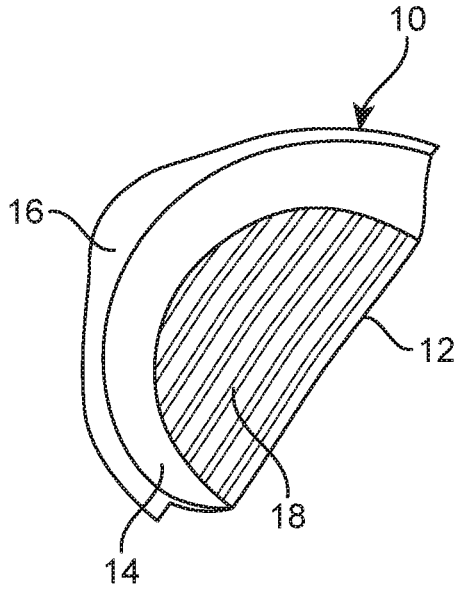
FIG. 3 exemplarily illustrates a perspective view of the sheet retainer 10 in an embodiment of the present invention. The sheet retainer 10 comprising a base member 12 with a textured surface 18, a rail member 14 extends vertically from at least one corner area of the base member 12 and a rim portion 16 of the rail member 14 projects outwards from the base member 12 to form a grip member, is illustrated.
Figure 4:
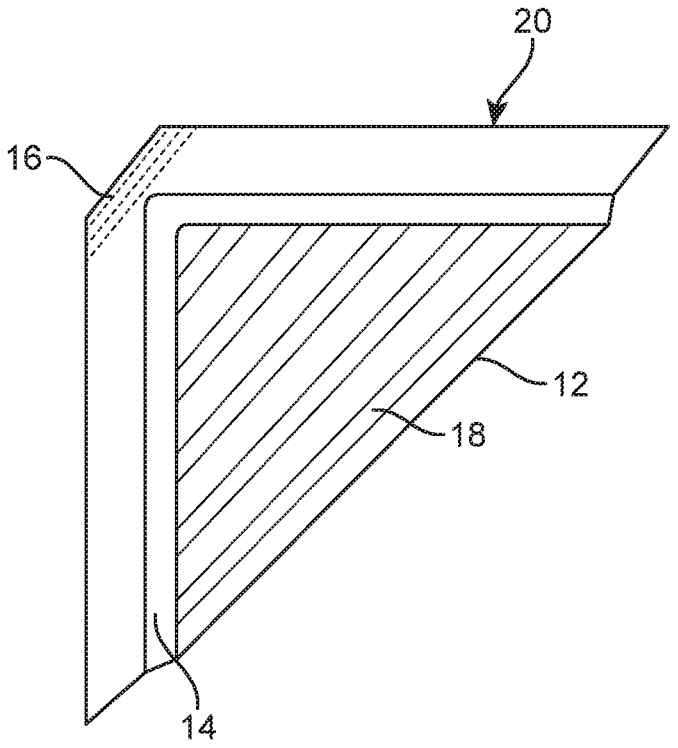
FIG. 4 exemplarily illustrates a perspective view of the sheet retainer 20 in another embodiment of the present invention. A triangular shaped base member 12, is illustrated.

The sheet retainer (10, 20) comprises a base member 12, a rail member 14, and a grip member. The base member 12 comprises a textured surface 18. The rail member 14 extends vertically from at least a portion of an end of the base member 12, as shown in FIG. 3. The rail member 14 comprises a rim portion 16, which projects outwards from the base member 12 to form the grip member. In another embodiment, the rail member 14 extends vertically from at least one corner area of the base member 12, as shown in FIG. 4.

The grip member enables to conveniently place, pull, push or remove the sheet retainer (10, 20) during a bed making process. The base member 12 is placed beneath a corner edge of the mattress securing the bed sheet underneath and pushed against the rail member 14 to maintain the bed sheet onto the mattress in a taut position.

In one embodiment, the base member 12 comprises a geometrical shape. In another embodiment, the base member 12 of the sheet retainer 10 is elliptical in shape. In yet another embodiment, the base member 12 of the sheet retainer 20 is triangular in shape. In yet another embodiment, the base member 12 comprises any shape, including but not limited to, elliptical, oval, circular, rectangular or triangular.

In one embodiment, the textured surface 18 is an irregular pattern of a plurality of projections and a plurality of pits. In another embodiment, the textured surface 18 is a regular pattern of a plurality of projections and a plurality of pits. In yet another embodiment, the textured surface 18 comprises a pattern of grooves, channels, peaks or a combination of grooves, channels, peaks.

In one embodiment, the sheet retainer (10, 20) is made of any material, including but not limited to, silicone. In another embodiment, the sheet retainer (10, 20) is produced in various sizes and styles to fit onto any type of bed or mattress. In yet another embodiment, the sheet retainer (10, 20) could be produced in different color and print configuration, to use in conjunction with matching bed sheets. In yet another embodiment, the sheet retainer (10, 20) is 8 inches in diameter and 4 inches in height. In yet another embodiment, the sheet retainer 10 comprising the base member 12 is 7½" in width and 8½" in height and the rail member 14 is 2½" in height.

During the bed making process, the base member 12 of the sheet retainer (10, 20) is placed beneath each corner of the mattress securing a bed sheet material there beneath. Then the base member 12 is butted against the rail member 14. The sheet retainer (10, 20) comprising the textured surface 18 retains the bed sheet fitted onto the mattress in the taut condition and prevents dislodging of bed sheet from the mattress.

Advantageously, the sheet retainer (10, 20) of the present invention is easy to install and remove conveniently while making beds and keeps bedclothes smoothly in place while sleeping. The sheet retainer (10, 20) is suitable for any consumer and institutions, such as hotels, motels, nursing homes, hospitals, assisted living centers, halfway houses, and community shelters. The sheet retainer (10, 20) is configured to hold the bed sheet tucked beneath the mattress in taut condition without tearing or ripping the bed sheet, or without causing accidental damage to the mattress or personal damage to the user during use.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A sheet retainer, comprising:

a base member having a textured surface, and a rail member extends vertically from at least a portion of an end of the base member, wherein the base member is placed beneath a corner edge of a mattress securing a bed sheet and butted against the rail member to maintain the bed sheet onto the mattress in a taut position, wherein the rail member further comprises a rim portion, wherein the rim portion of the rail member projects outwards from the base member to form a grip member.

2. The sheet retainer of claim 1, wherein the textured surface is an irregular pattern of a plurality of projections and a plurality of pits.

3. The sheet retainer of claim 1, wherein the textured surface is a regular pattern of a plurality of projections and a plurality of pits.

4. The sheet retainer of claim 1, wherein the base member comprises a geometrical shape.

5. The sheet retainer of claim 1, wherein the base member comprises at least any one of a circular, oval, elliptical or rectangular shape.

6. The sheet retainer of claim 1, is made of silicone material.

7. A sheet retainer, comprising:

a base member having a textured surface, and a rail member extends vertically from at least a portion of an end of the base member, wherein the rail member comprises a rim portion projecting outward from the base member to form a grip member, and wherein the base member is placed beneath a corner edge of a mattress securing a bed sheet and butted against the rail member to maintain the bed sheet onto the mattress in a taut position.

8. A sheet retainer, comprising:

a base member having a textured surface, and a rail member extends vertically from at least one corner area of the base member, wherein the base member is placed beneath a corner edge of a mattress securing a bed sheet and butted against the rail member to maintain the bed sheet onto the mattress in a taut position, wherein the rail member further comprises a rim portion, wherein the rim portion of the rail member projects outwards from the base member to form a grip member.

* * * * *